US005115526A

United States Patent [19]

Boyd

[11] Patent Number: 5,115,526

[45] Date of Patent: May 26, 1992

[54] SOFTSIDE WATERBED FOUNDATION AND PACKAGE

[76] Inventor: Dennis Boyd, 14457 Rouge River, Chesterfield, Mo. 63017

[21] Appl. No.: 679,223

[22] Filed: Apr. 2, 1991

[51] Int. Cl.[5] ..... A47C 27/08; A47C 19/00

[52] U.S. Cl. ..... 5/451; 5/400; 5/917

[58] Field of Search ..... 5/451, 450, 457, 449, 5/400, 452

[56] References Cited

U.S. PATENT DOCUMENTS

| | | | |
|---|---|---|---|
| 3,735,432 | 5/1973 | Kreten et al. | 5/451 |
| 3,766,579 | 10/1973 | Shields | 5/452 |
| 4,244,065 | 1/1981 | Hartwell | 5/451 |
| 4,245,364 | 1/1981 | Calleance | 5/452 |
| 4,517,692 | 5/1985 | Vogel | 5/451 |
| 4,532,662 | 8/1985 | Sama | 5/451 |

FOREIGN PATENT DOCUMENTS

| | | | |
|---|---|---|---|
| 428124 | 7/1967 | Switzerland | 5/450 |
| 2154445 | 9/1985 | United Kingdom | 5/451 |

*Primary Examiner*—Alexander Grosz

*Attorney, Agent, or Firm*—Polster, Leider, Woodruff & Lucchesi

[57] ABSTRACT

A softside waterbed foundation includes a pneumatically inflatable base and a compressible collar extending around the periphery of the base. The collar extends upwardly from the base to define a cavity for a water mattress. The base includes anti-bowing structure for preventing the base from bowing upwardly in the center during and after inflation. Alternatively, the base is composed of compressible, resilient foam, as is the collar. In the alternative construction, there is a closed vinyl shell enclosing the collar and the base. The shell has a closable port therethrough so that air in the closed vinyl shell may be evacuated through the port to reduce the volume of the collar and base for shipping. Because of its unique construction, the foundation and a water mattress may be shipped in a box having a girth plus length of no greater than 130".

12 Claims, 1 Drawing Sheet

SOFTSIDE WATERBED FOUNDATION AND PACKAGE

BACKGROUND OF THE INVENTION

This invention relates generally to waterbed foundations, and more particularly to a novel softside, shallow-fill waterbed foundation especially suitable for shipping.

The advantages and benefits of waterbeds over conventional beds are well-known. There have, however, heretofore been some perceived disadvantages of waterbeds which have slowed their acceptance. One of these perceived disadvantages has been the presence of a hard wooden frame around the outside of the waterbed mattress(es) to hold the mattress(es) in place.

This particular perceived disadvantage has been overcome in part recently by the introduction of softside waterbeds. These waterbeds use a layer of foam which extends as a collar around the periphery of the waterbed to hold the waterbed mattress in place. This particular construction, however, could be improved, since the foam collar is relatively bulky and, therefore, relatively expensive to ship.

SUMMARY OF THE INVENTION

Among the various objects and features of the invention may be noted the provision of an improved waterbed foundation which eliminates the need for a hard frame around the waterbed mattress.

Another object is the provision of such a waterbed foundation which has reduced bulk for shipping purposes.

A third object is the provision of an improved waterbed foundation which is relatively inexpensive and simple in construction.

A fourth object is the provision of an improved waterbed foundation with a reduced number of parts.

Other objects and features will be in part apparent and in part pointed out hereinafter.

Briefly, in a first aspect of the present invention, a softside waterbed foundation includes a pneumatically inflatable base and a compressible collar. The collar extends around the periphery of the pneumatically inflatable base and extends upwardly therefrom. The collar forms soft sides for the waterbed and, in combination with the pneumatically inflatable base, defines a cavity for a water mattress. The pneumatically inflatable base includes anti-bowing structure for preventing the base from bowing upwardly in the center thereof during and after inflation of the base.

In a second aspect of the present invention, a softside waterbed foundation includes a base composed of compressible, resilient foam and a collar composed of compressible, resilient foam. The collar extends around the periphery of the base and extends upwardly therefrom. The collar forms soft sides for the waterbed and, in combination with the base, defines a cavity for a water mattress. A closed vinyl shell encloses the collar and the base, which shell has a closable port therethrough so that air in the closed vinyl shell may be evacuated through the port to reduce the volume of the collar and base for shipping.

In a third aspect of the present invention, a water mattress and softside waterbed foundation package includes a box which has a girth plus length of no greater than 130". A softside waterbed foundation is disposed in the box, which foundation has a reduced volume for shipping and a standard volume during use, the standard volume being significantly greater than the reduced volume. A water mattress is also disposed in the box, which water mattress has a reduced volume for shipping and a standard volume during use, the standard volume being significantly greater than the reduced volume. The foundation and mattress may be shipped as a unit in a box having a girth plus length no greater than 130".

BRIEF DESCRIPTION OF THE DRAWINGS

Similar reference characters indicate similar parts throughout the several views of the drawings.

DESCRIPTION OF THE PREFERRED EMBODIMENT

Figure 1:
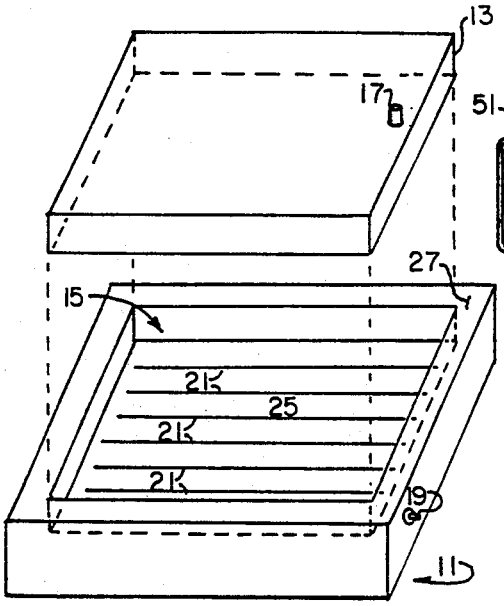
FIG. 1 is a perspective view illustrating a waterbed foundation of the present invention in combination with a water mattress.

Turning to the drawings, a waterbed foundation 11 of the present invention is shown for use with a water mattress 13. Although water mattress 13 is shown as a single bladder type mattress, it should be realized that a plurality of bladders or water-filled tubes could be used instead to form water mattress 13.

Foundation 11 is of the shallow-fill type, which provides a relatively shallow cavity 15 for water mattress 13. Typically shallow-fill mattresses have a preferred thickness, when inflated with water (through a conventional water valve 17), of 1½ to 2 inches or so. Cavity 15 has a corresponding depth to accommodate water mattress 13. Shallow-fill waterbeds have the advantage that their weight is supportable by conventional bed frames (not shown).

Waterbed foundation 11 is of the softside type, which means that it is self-supporting, without a hard (typically wooden) frame around the sides of the bed. Foundation 11 includes a closable port or air valve 19 at one end, for reasons which will become apparent. Also shown in FIG. 1 are a series of seals 21 extending longitudinally along the base of cavity 15.

Figure 2:
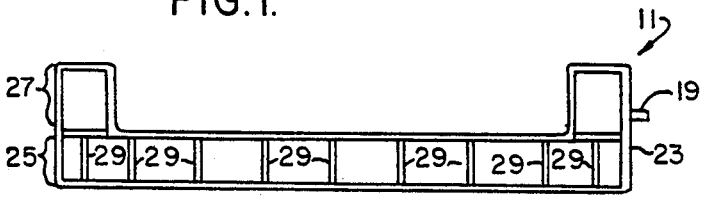
FIG. 2 is a sectional view, with parts broken away for clarity, illustrating the internal structure of one embodiment of the waterbed foundation of the present invention.
Figure 8:
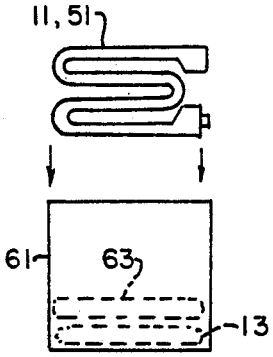
FIG. 8 is a side elevation illustrating a waterbed foundation/water mattress package of the present invention.

Turning to FIG. 2, it can be seen that in one embodiment, foundation 11 consists of a closed vinyl shell 23 which forms a pneumatically inflatable base 25 and a pneumatically inflatable compressible collar 27. Although a single port or valve 19 is shown for inflating and deflating foundation 11, any number of valves could be used as desired. With a single valve, fluid communication paths must be left open through the interior of closed shell 23 to allow air to flow into and out of the various chambers shown in FIG. 2. For this reason, the seals 21 (shown in FIG. 1) do not extend the full length of the foundation. Similarly, collar 27 is in fluid communication with base 25 in the embodiment of the invention shown, so that both collar and base can be inflated through the same port 19. Alternatively, there can be provided separate inflation ports for the base and the collar.

As is best seen in FIG. 1, collar 27 extends upwardly around the periphery of pneumatically inflatable base 25 and forms the soft sides for the waterbed. The collar and base define cavity 15 for water mattress 13. Although base 25 is shown having a conventional rectangular shape, it should be understood that the present invention is not limited to any particular standard shape.

Foundation 11 (and specifically base 25) includes anti-bowing means 29 (described below in connection with FIG. 5) for preventing the base from bowing upwardly in the center thereof during and after inflation of the base. It should be appreciated that without anti-bowing means 29, the center of base 25 would be significantly higher than the edges, due to the physical characteristics of the vinyl shell. That would, of course, be unacceptable for a waterbed foundation.

It should be appreciated that when air is evacuated from foundation 11 the resulting package is extremely small compared to prior waterbed foundations. This deflated foundation can easily be packaged with an unfilled water mattress in a box of a size suitable for shipping. The resulting box is much less bulky than the boxes used to ship prior foundations, so the cost of shipping is much less.

Figure 3:
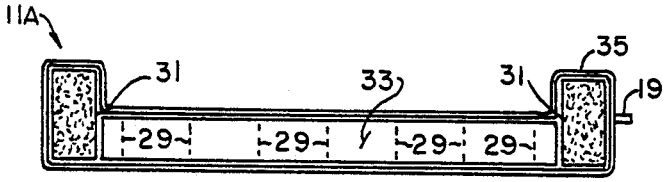
FIG. 3 is a sectional view, similar to FIG. 2, illustrating the internal structure of a second embodiment of the waterbed foundation of the present invention.

Turning to FIG. 3, there is shown a variation 11A of the waterbed foundation of the present invention. Variation 11A differs from foundation 11 in that the collar is composed of a compressible, resilient foam (the foam collar is labelled 31 in FIG. 3) such as polyurethane foam. The base in foundation 11A is pneumatically inflatable, as before, and is labelled 33. A closed vinyl shell 35 surrounds foam collar 31 and pneumatically inflatable base 33. It has been found that by deflating base 33 and evacuating the air from closed shell 35 through closable port 19, the volume of foundation 11A can be significantly reduced for shipping. This reduction does not occur solely because of the deflation of pneumatically inflatable base 33. Specifically, when a vacuum is applied to closed shell 35, foam collar 31 is significantly compressed, thereby reducing the shipping size of the entire foundation.

Figure 4:
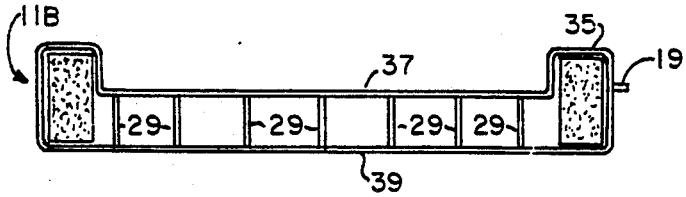
FIG. 4 is a sectional view, similar to FIGS. 2 and 3, illustrating the internal structure of a third embodiment of the waterbed foundation of the present invention.

A slight variation of foundation 11A is shown in FIG. 4 as foundation 11B. Foundation 11B, instead of having a separate pneumatically inflatable base 33, simply uses the top and bottom surfaces (labelled 37 and 39) of closed shell 35 to form the pneumatically inflatable base.

Figure 5:
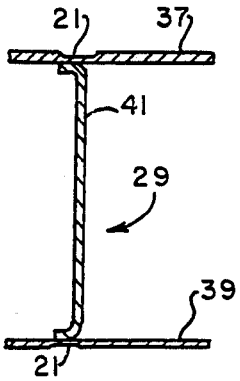
FIG. 5 is a cross-sectional view, on an enlarged scale, illustrating the anti-bowing feature of the waterbed foundation of FIGS. 1–4.

Turning to FIG. 5, the anti-bowing means is seen to include a strip 41 of vinyl extending from top surface 37 to bottom surface 39 of the base. The construction is the same in foundations 11, 11A, and 11B. At both top and bottom, strip 41 is suitably secured or sealed (e.g., by welding) to the corresponding surface of the base to form a structure which strongly resists bowing of the base. These seals are indicated by the label 21 in the Figs. From FIG. 2 (for example) it can be seen that there are a plurality of anti-bowing strips, which are generally parallel to each other. As can be seen from the extent of seals 21 in FIG. 1, these generally parallel strips extend substantially across the base of the waterbed foundation.

Figure 6:
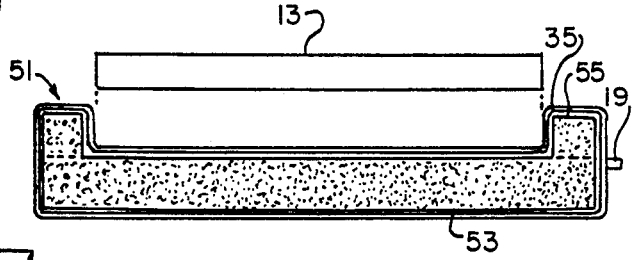
FIG. 6 is a sectional view, similar to FIGS. 2–4, illustrating the internal structure of a fourth embodiment of the waterbed foundation of the present invention in combination with a water mattress.

Turning to FIG. 6, there is shown another embodiment of the waterbed foundation of the present invention, labelled 51. Foundation 51 includes closed vinyl shell 35 and closable port or valve 19, but instead of being pneumatically inflatable, the base and collar (labelled 53 and 55) of foundation 51 are made of compressible, resilient, polyurethane foam (or some other suitable compressible material). As indicated by the phantom lines in FIG. 6, collar 55 may be unitary with the base, or not, as desired. In any event it is preferred that the collar be suitably secured to the base.

Like foundations 11, 11A, and 11B, foundation 51 is a shallow-fill foundation having a cavity for water mattress 13 with a depth of 1½ to 2". Base 53 (not counting the thickness of collar 55) is approximately 3" thick, so that the entire foundation is 5" in height or less.

Figure 7:
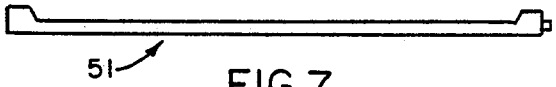
FIG. 7 is a side elevation of the foundation of FIG. 6, illustrating its reduced size when evacuated for shipping.

By evacuating the air from shell 35 and drawing a vacuum, the volume of foundation 51 can be substantially reduced to that shown in FIG. 7 (although the reduction is not as great as that achieved with the pneumatically inflatable foundations of FIGS. 2–4). Applying a vacuum to the shell causes the foam making up collar 55 and base 53 to drastically compress.

Once compressed from their standard volumes to their shipping volumes, any of the foundations of the present invention may be readily packaged in a box 61 having a girth plus length of no greater than 130", a standard shipping size. In fact the foundation may be placed in the box with unfilled water mattress 13 and a suitable fabric mattress cover 63 without overfilling the box. This drastically reduces the shipping cost of a complete waterbed foundation/mattress set.

In addition, the constructions shown in FIGS. 1–6 result in a foundation which when combined with a filled water mattress is light enough to use on a conventional box spring and on a conventional four-legged metal frame For example, a twin size foundation with filled water mattress on the present invention weighs only 109 pounds or so, approximately only 100 pounds greater than a corresponding conventional mattress. This weight differential is well within the limits for conventional box springs and conventional four-legged metal frames. Similarly, in the queen size, the foundation and filled water mattress weighs only 200 pounds or so, approximately only 175 pounds more than conventional mattresses. This weight differential is again well within limits for conventional box springs and conventional four-legged metal frames. The present invention, therefore, allows a water mattress to be supported on relatively inexpensive conventional box springs and four-legged metal frames.

In view of the above it will be seen that the various objects and features of the invention are achieved and other advantageous results obtained. The examples of the invention disclosed herein are intended as illustrative, and not in a limiting sense.

What is claimed is:

1. A softside waterbed foundation comprising:

a pneumatically inflatable base; and a compressible collar extending around the periphery of the pneumatically inflatable base and extending upwardly therefrom, said collar forming soft sides for the waterbed and, in combination with the pneumatically inflatable base, defining a cavity for a water mattress;

said pneumatically inflatable base including anti-bowing means for preventing said base from bowing upwardly in the center thereof during and after inflation of said base;

said collar being pneumatically inflatable;

said collar being in fluid communication with the base.

2. A softside waterbed foundation comprising:

a pneumatically inflatable base;

a compressible collar extending around the periphery of the pneumatically inflatable base and extending upwardly therefrom, said collar forming soft side for the waterbed and, in combination with the pneumatically inflatable base, defining a cavity for a water mattress;

said pneumatically inflatable base including anti-bowing means for preventing said base from bowing upwardly in the center thereof during and after inflation of said base;

said collar being composed of a compressible resilient foam; and a closed vinyl shell enclosing the foam collar and the pneumatically inflatable base, and a closable port into the closed vinyl shell so that the volume of the collar and the pneumatically inflatable base may be reduced for shipping by evacuating the closed vinyl shell.

3. The softside waterbed foundation as set forth in claim 2 wherein the pneumatically inflatable base is composed of top and bottom of the pneumatically inflatable base.

4. A softside waterbed foundation comprising:

a base composed of compressible, resilient foam;

a collar composed of compressible, resilient foam, said collar extending around the periphery of the base and extending upwardly therefrom, said collar forming soft sides for the waterbed and, in combination with the base, defining a cavity for a water mattress; and at least one closed vinyl shell enclosing the collar and the base, said shell having a closable port therethrough so that air in the closed vinyl shell may be evacuated through said port to reduce the volume of the collar and base for shipping.

5. The softside waterbed foundation as set forth in claim 4 wherein the collar is fixedly secured to the base.

6. The softside waterbed foundation as set forth in claim 5 wherein the collar and base are unitary.

7. The softside waterbed foundation as set forth in claim 4 further including a water mattress disposed in said cavity.

8. The softside waterbed foundation as set forth in claim 7 wherein the water mattress when filled in combination with the foundation is sufficiently light to be supported on a conventional box spring.

9. The softside waterbed foundation as set forth in claim 7 wherein the water mattress when filled in combination with the foundation is sufficiently light to be supported on a conventional four-legged metal frame.

10. The softside waterbed foundation as set forth in claim 4 wherein the collar extends less than 2" up from the base.

11. The softside waterbed foundation as set forth in claim 10 wherein the collar extends approximately 1½" up from the base.

12. The softside waterbed foundation as set forth in claim 4 wherein the base is approximately 3" thick.

* * * * *

UNITED STATES PATENT AND TRADEMARK OFFICE

CERTIFICATE OF CORRECTION

PATENT NO. : 5,115,526

DATED : May 26, 1992

INVENTOR(S) : Dennis Boyd

It is certified that error appears in the above-identified patent and that said Letters Patent is hereby corrected as shown below:

Claim 3, Column 5, Line 32 is "composed of top and bottom of pneumatically" should be -- composed of vinyl, said closed vinyl shell including the vinyl composing the --.

Signed and Sealed this

Twentieth Day of July, 1993

*Attest:*

Michael K. Kirk

MICHAEL K. KIRK

*Attesting Officer*

*Acting Commissioner of Patents and Trademarks*